US012433380B2

(12) United States Patent
Cai

(10) Patent No.: US 12,433,380 B2
(45) Date of Patent: Oct. 7, 2025

(54) FOLDING AND UNFOLDING LABOR-SAVING AUTOMATIC STRUCTURE AND UMBRELLA

(71) Applicant: Sun City (xiamen) outdoor Technology Co., Ltd., Xiamen (CN)

(72) Inventor: Yujin Cai, Xiamen (CN)

(73) Assignee: Sun City (xiamen) outdoor Technology Co., Ltd., Xiamen (CN)

( * ) Notice: Subject to any disclaimer, the term of this patent is extended or adjusted under 35 U.S.C. 154(b) by 263 days.

(21) Appl. No.: 18/224,172

(22) Filed: Jul. 20, 2023

(65) Prior Publication Data

US 2024/0381986 A1 Nov. 21, 2024

(30) Foreign Application Priority Data

May 20, 2023 (CN) ..... 202310573393.4

(51) Int. Cl.
*A45B 25/16* (2006.01)

(52) U.S. Cl.
CPC ..... *A45B 25/16* (2013.01)

(58) Field of Classification Search
CPC ..... A45B 2200/1081; A45B 25/143; A45B 25/16
See application file for complete search history.

(56) References Cited

U.S. PATENT DOCUMENTS 5,267,583 A * 12/1993 Wu ..... A45B 25/143 135/25.1
5,566,698 A * 10/1996 Yu ..... A45B 25/143 135/25.4
5,626,160 A * 5/1997 Ko ..... A45B 25/143 135/22
6,481,450 B2 * 11/2002 Chen ..... A45B 25/143 135/25.4
6,729,340 B2 * 5/2004 Chen ..... A45B 25/143 135/25.4
9,144,276 B2 * 9/2015 Ni ..... A45B 25/16
9,526,307 B1 * 12/2016 Hsieh ..... A45B 25/16

* cited by examiner

*Primary Examiner* — Noah Chandler Hawk
(74) *Attorney, Agent, or Firm* — Birchwood IP

(57) ABSTRACT

Provided is a folding and unfolding labor-saving automatic structure and umbrella. The folding and unfolding labor-saving automatic structure includes a main body seat, a moveable button, a baffle assembly and an H-shaped lever. The H-shaped lever is rotatably arranged between the moveable button and the baffle assembly. According to the present disclosure, a baffle assembly in a conventional automatic umbrella handle is moved downward so that a first spring can be extended deeper into the handle, whereby the degree of compression of the first spring is reduced, and when compressing downward the same length of spring, a user needs to apply a less force. While the position of the baffle assembly is moved downward, the original distance increases, a slide assembly and a rotatable H-shaped lever are arranged. When the slide assembly moves downwardly, the H-shaped lever is triggered to rotate, driving the baffle assembly to move.

10 Claims, 10 Drawing Sheets

FOLDING AND UNFOLDING LABOR-SAVING AUTOMATIC STRUCTURE AND UMBRELLA

CROSS-REFERENCE TO RELATED APPLICATIONS

This is a U.S. patent application which claims the priority and benefit of Chinese Patent Application Number 202310573393. 4, filed on May 20, 2023, the disclosure of which is incorporated herein by reference in its entirety.

TECHNICAL FIELD

The present disclosure relates to the technical field of umbrellas, more particularly to a folding and unfolding labor-saving automatic structure and umbrella.

BACKGROUND

Existing automatic folding and unfolding umbrellas are generally provided with a support spring in an inner cavity of a central rod to offer a dynamic to stretch the central rod, and each rib is provided with a tension spring and the like structure to offer a dynamic to fold the rib. The unfolding of umbrella is achieved by the support spring releasing elasticity, and the folding of umbrella is achieved by the tension spring on the rib releasing elasticity. The central rod is retracted to store energy for the unfolding of umbrella. However, whether depressing the central rod from the umbrella tail end or pulling downward the runner to retract the central rod, a relatively big force is needed. It is very inconvenient for the old, children and the weak to use. Since the support spring is of strong elasticity, if the old, children and the weak cannot retract the central rod all at a time, the central rod is likely to rebound to hurt them. Therefore, various folding and unfolding labor-saving umbrellas appear on the market.

For example, anti-rebound automatic folding and unfolding umbrellas, where during the folding process the central rod can be stopped at any time while being retracted, without rebounding, even the old and children can use it safely, however, the force required to retract the central rod is not reduced.

Another example, in order to increase the space of contraction of the support spring, the spring is changed from one to two. When folding and unfolding the umbrella, the two springs can be overlapped on the spring connection sleeve, so that the umbrella can be folded and unfolded more easily. However, such structure is complicated, with shortcomings of high assembly cost and assembly difficulties.

SUMMARY

Other features and advantages of the present disclosure will be illustrated in the following description and partially become apparent from the description or be understood by implementing the present disclosure. The purpose and other advantages of the present disclosure can be implemented and obtained through the description and the structures specified in the accompanying drawings of the description.

The object of the present disclosure is to overcome the above shortcomings and provide a folding and unfolding labor-saving automatic structure and umbrella, where a baffle assembly in a conventional automatic umbrella handle is moved downward so that a first spring can be extended deeper into the handle, whereby the length of the first spring increases and the degree of compression is reduced, and when compressing downward the same length of spring, a user needs to apply a less force, achieving the purpose of labor-saving folding of umbrella. While the position of the baffle assembly is moved downward, a distance between the baffle assembly and a moveable button increases. In order to adapt to the increased distance, an up-down moveable slide assembly and a rotatable H-shaped lever are arranged. When the slide assembly moves downwardly, the H-shaped lever is triggered to rotate, driving the baffle assembly to move, whereby completing the process of automatic folding and unfolding of umbrella.

The present disclosure provides a folding and unfolding labor-saving automatic structure, including a main body seat, a moveable button, a baffle assembly and an H-shaped lever. The main body seat has an accommodation cavity formed therein. The moveable button is moveably arranged inside the main body seat and has a slide assembly arranged thereon. The baffle assembly is arranged inside the accommodation cavity and is located below the moveable button. The H-shaped lever rotatably is arranged inside the accommodation cavity, and includes a rotating shaft arranged inside the accommodation cavity and two lever arms rotatably connected to the rotating shaft, wherein the lever arm portions above the rotating shaft are power arms, the lever arm portions below the rotating shaft are resistance arms, the power arms are provided thereon with power arm protrusions, the two power arm protrusions can moveably abut against the slide assembly, and the two resistance arms abut against the baffle assembly.

According to the present disclosure, the position of the baffle assembly is arranged close to the tail portion of the handle, greatly prolonging the contraction space of the first spring, whereby reducing the degree of compression, and when compressing downward the same length of spring, a user needs to apply a less force, achieving the purpose of labor-saving folding of umbrella. In addition, since the position of the baffle assembly is moved downward, a distance between the slide assembly located above the baffle assembly and the baffle assembly increases. Hence, the present disclosure arranges an H-shaped lever between the slide assembly and the baffle assembly, so that the H-shaped lever can achieve a moveable connection between the slide assembly and the baffle assembly. When the slide assembly moves downwardly, the H-shaped lever is triggered to rotate, driving the baffle assembly to move, whereby completing the process of automatic folding and unfolding of umbrella.

In some embodiments, the slide assembly includes a slider spring, a second chute and a slide block. The moveable button is formed with a first chute. The slide block is formed therein with a second chute communicated with the first chute. The slider spring has one end connected to the slide block and the other end running through the second chute and the first chute to connect to the moveable button. The slide block is provided thereon with two slide block protrusions that moveably abut against the power arm protrusions. The main body seat is equivalent to the handle in an umbrella. The arranged accommodation cavity is configured to fix the central rod. The horizontally moveable button is configured to control the folding and unfolding of the umbrella. When the umbrella is folded, the runner abuts against the slide assembly, whereby the slide block can be depressed under the function of the slider spring. Since the tail end of the slide block is provided with slide block protrusions, where the slide block protrusions abut against the two power arm protrusions on the power arms of the H-shaped lever in an original state, so that the H-shaped lever is slightly rotated, during the depressing process, the protrusions of the two disengage from one another, the slide block protrusions move downwardly while the H-shaped lever is restored.

In some embodiments, the baffle assembly includes a baffle, a baffle spring and a U-shaped baffle sleeve. The baffle is moveably arranged inside a bottom of the baffle sleeve and is connected to the main body seat through the baffle spring. A top of the baffle sleeve is a baffle arm. Two baffle arms abut against the resistance arms. The baffle can horizontally move under the function of the baffle spring. A hook of the automatic umbrella is buckled between the two baffle arms. Tail ends of the baffle arms abut against tail ends of the resistance arms. When the resistance arms move, the baffle arms are pushed, the baffle spring is compressed, and the hook fixed between the two baffle arms is released. When the hook is again clamped between the two baffle arms, due to the arrangement of the baffle spring, the clamping process is smooth, causing no movement of the resistance arms.

In some embodiments, the main body seat is formed therein with a button slot perpendicular to an extension direction of the accommodation cavity. The moveable button is arranged inside the button slot. The moveable button includes a U-shaped iron and a button spring. The U-shaped iron is moveably connected to the main body seat through the button spring. The arrangement of the button spring allows the U-shaped iron to move horizontally, thereby completing the buckling process of the runner during the manual folding of umbrella. Meanwhile, the horizontal movement of the moveable button can change the abutting state between the slide block protrusion and the power arm protrusion, achieving the collapsing of the umbrella fabric.

In some embodiments, the moveable button further includes an external button. The external button is connected to the U-shaped iron and is extended to outside the accommodation cavity. The first chute is arranged above the external button. A slider guide pin is further arranged inside the slider spring. The external button is extended to outside the accommodation cavity for a user to touch. The external button is further connected to the slide assembly and the U-shaped iron through the slider guide pin. When the external button is pressed to unfold the umbrella automatically, the U-shaped iron moves, the runner disengages from the buckling state to move upwardly, the pressure against the slide assembly disappears, and the slide block protrusion moves upwardly under the function of the slider spring to abut against the power arm protrusion again, and the H-shaped lever is slightly rotated.

The present disclosure further provides a folding and unfolding labor-saving automatic umbrella, including a central rod and a handle having the folding and unfolding labor-saving automatic structure, wherein the central rod is provided therein with a first spring and a bullet like tip. The bullet like tip has a top end arranged inside the first spring and a bottom end able to buckle with the baffle so that the central rod is retracted.

In some embodiments, the central rod includes an inner tube, a middle tube and an outer tube. The middle tube is sleeved outside the inner tube. The outer tube is sleeved outside the middle tube. The outer tube is provided thereon with a notch. A runner is sleeved outside the outer tube. The outer tube is provided with a wedge-shape block. The moveable button is buckled with the wedge-shape block. The outer tube abuts against the slide assembly. The central rod is equivalent to a central rod in a conventional manual folding umbrella, which is arranged as several segments to complete conventional folding and retraction functions. Herein, the inner tube arranged inside the middle tube is longer than that of a conventional automatic umbrella, which is configured to contain and protect the first spring and maintain the stable movement of the first spring. The inner tube is extended to the baffle assembly inside the handle, for the hook inside the first spring to buckle with the baffle assembly. The outer tube is connected to the runner and is arranged below the runner. When the umbrella is folded, the runner is pulled downwardly and the outer tube abuts against the slide assembly first, so that the slide assembly slides downwardly. Meanwhile, the wedge-shape block arranged on the outer tube is buckled with the U-shaped iron on the slide assembly, fixing the outer tube and the runner.

In some embodiments, the first spring is arranged inside the inner tube.

In some embodiments, the notch is provided therein with a pulley assembly. The pulley assembly includes a pull rope. The pull rope has one end connected to the notch and the other end extending through the first spring. The other end of the pull rope is provided with a hook. The hook is clamped on the baffle assembly. The pulley assembly is a conventional arrangement in existing automatic umbrellas. The pulley assembly includes a first pulley and a second pulley. The first pulley is arranged inside the notch and the second pulley is arranged inside the runner. The pull rope is arranged between the first pulley and the second pulley. One end of the pull rope is fixed on the notch, while the other end passes around the second pulley located inside the runner and then goes toward the first pulley located inside the notch. After passing around the first pulley, the pull rope penetrates through the first spring and has the other end buckled on the baffle assembly inside the handle through the hook at the tail end. The baffle assembly can release the hook, and the up-down movement of the hook can achieve the up-down movement of the runner synchronously. When the baffle assembly is buckled with the hook, the runner is located at the top of the umbrella. When the baffle assembly releases the hook, the runner descends some distance, meanwhile causing the umbrella fabric to collapse.

In some embodiments, the umbrella further includes an umbrella rib. The umbrella rib includes an upper pull rod and a lower pull rod between which is arranged a second spring. Conventional automatic umbrellas have a second spring for folding umbrella added between the upper and lower pull rods of the umbrella rib. The number of the second springs is the same as that of the umbrella ribs. When to fold the umbrella, a user presses the button, then the runner descends some distance along the central rod. Under the driving of the second spring, the upper pull rod is collapsed, and the entire umbrella fabric is folded. Then the user pulls the descended runner to the handle to buckle, whereby completing the entire folding process of umbrella.

With the above technical solution, the present disclosure has the following beneficial effects.

According to the present disclosure, a baffle assembly in a conventional automatic umbrella handle is moved downward so that a first spring can be extended deeper into the handle, whereby the length of the first spring increases and the degree of compression is reduced, and when compressing downward the same length of spring, a user needs to apply a less force, achieving the purpose of labor-saving folding of umbrella. While the position of the baffle assembly is moved downward, a distance between the baffle assembly and a moveable button increases. In order to adapt to the increased distance, an up-down moveable slide assembly and a rotatable H-shaped lever are arranged. When the slide assembly moves downwardly, the H-shaped lever is triggered to rotate, driving the baffle assembly to move, whereby completing the process of automatic folding and unfolding of umbrella.

It should be understood that the above general description and the following detailed description are exemplary and explanative merely, which are not intended to limit the present disclosure.

Undoubtedly, this type of purpose and other purposes of the present disclosure will become more apparent from the following detailed description of preferred embodiments taken in conjunction with various accompanying drawings.

To make the above and other purposes, features and advantages of the present disclosure more apparent and understandable, one or more preferred embodiments are provided below to make a detailed description in conjunction with the accompanying drawings.

BRIEF DESCRIPTION OF DRAWINGS

For a better understanding of the present disclosure, accompanying drawings described hereinafter are provided to constitute one part of the present disclosure, which are used to illustrate the present disclosure together with the embodiments of the present disclosure, and are not intended to form a limitation on the preset disclosure.

In the accompanying drawings, similar elements are indicated by similar designators. In addition, the accompanying drawings are schematic and may not necessarily be drawn by the actual scale.

For a better understanding of the technical solution in the embodiments of the present disclosure or in the prior art, accompanying drawings required to be used in the description of the embodiments or the prior art are simply illustrated below. Apparently, the accompanying drawings described below are one or several embodiments of the present disclosure merely. For the ordinary skill in the field, other accompanying drawings may be obtained according to these accompanying drawings without creative effort.

Figure 1:
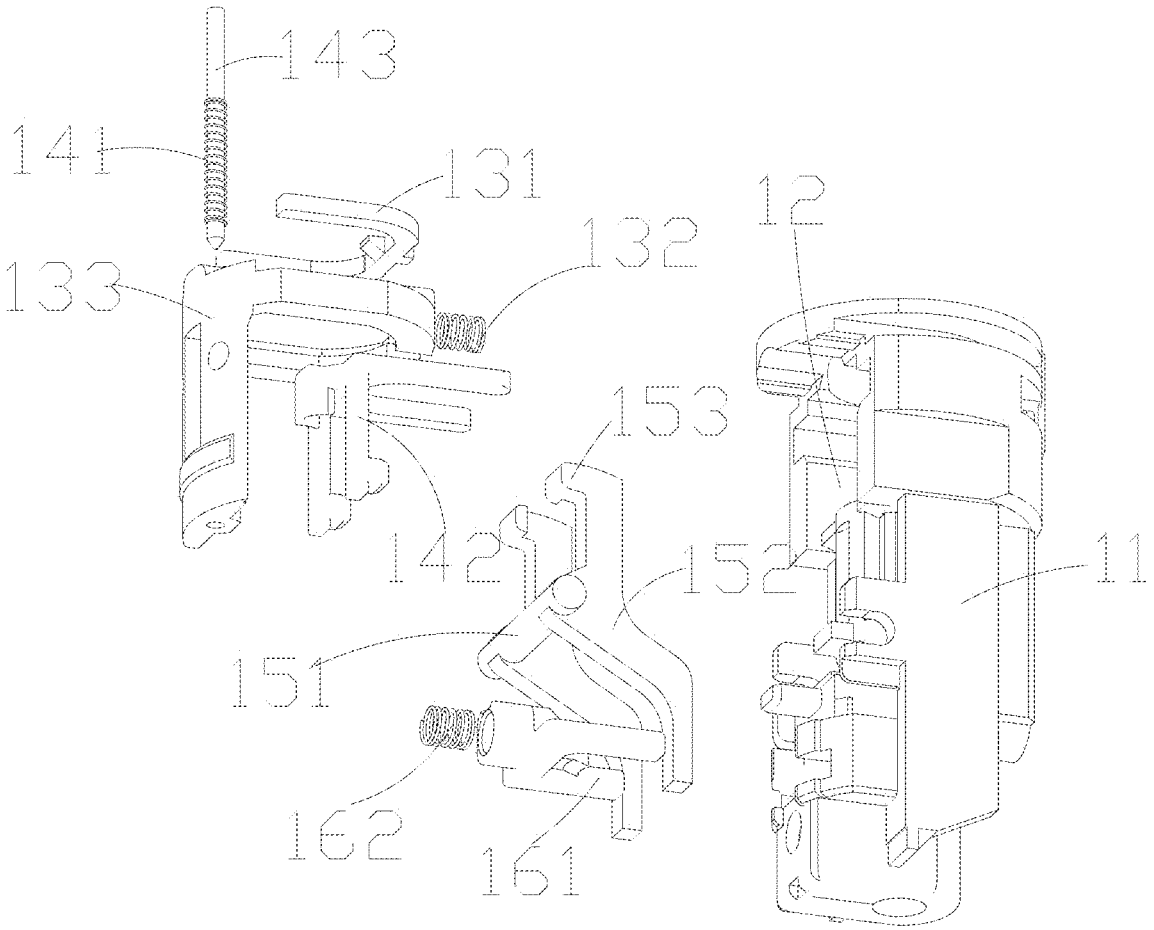

FIG. 1 is an internal perspective structure diagram of a handle in some embodiments of the present disclosure.

Figure 2:
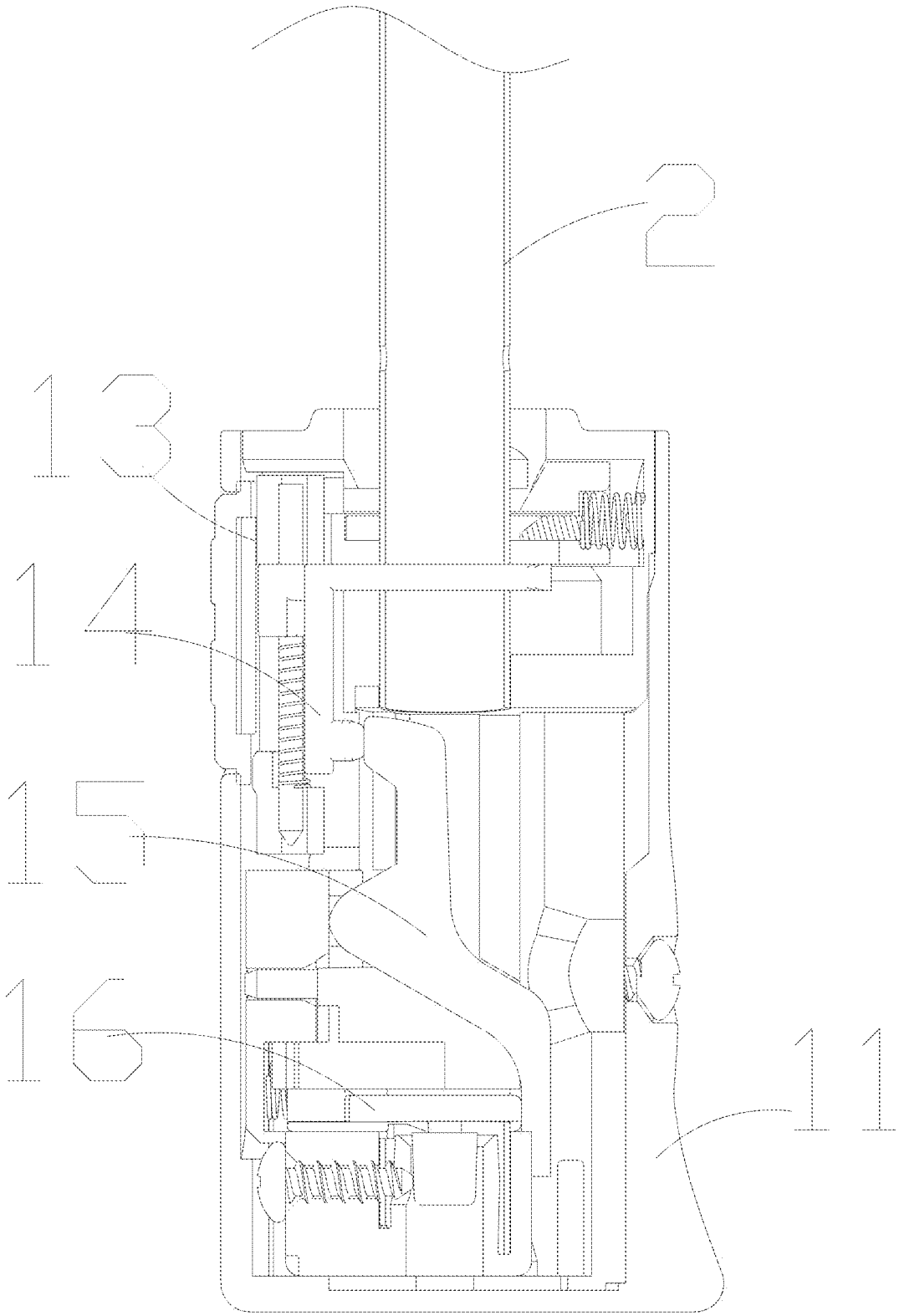

FIG. 2 is a sectional diagram of a handle structure in some embodiments of the present disclosure.

Figure 3:
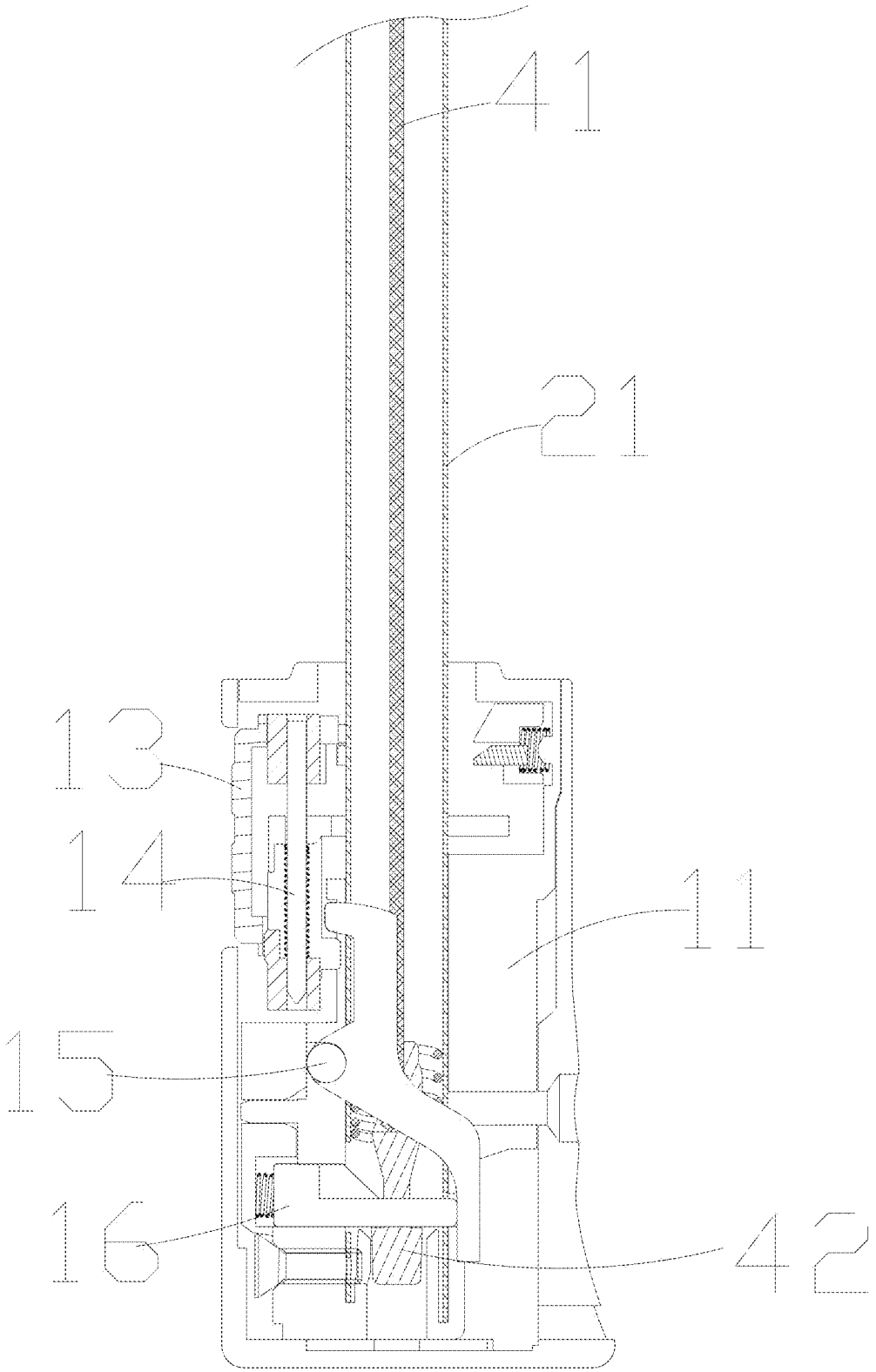

FIG. 3 is an internal structure diagram of a handle in some embodiments of the present disclosure when an umbrella is unfolded.

Figure 4:
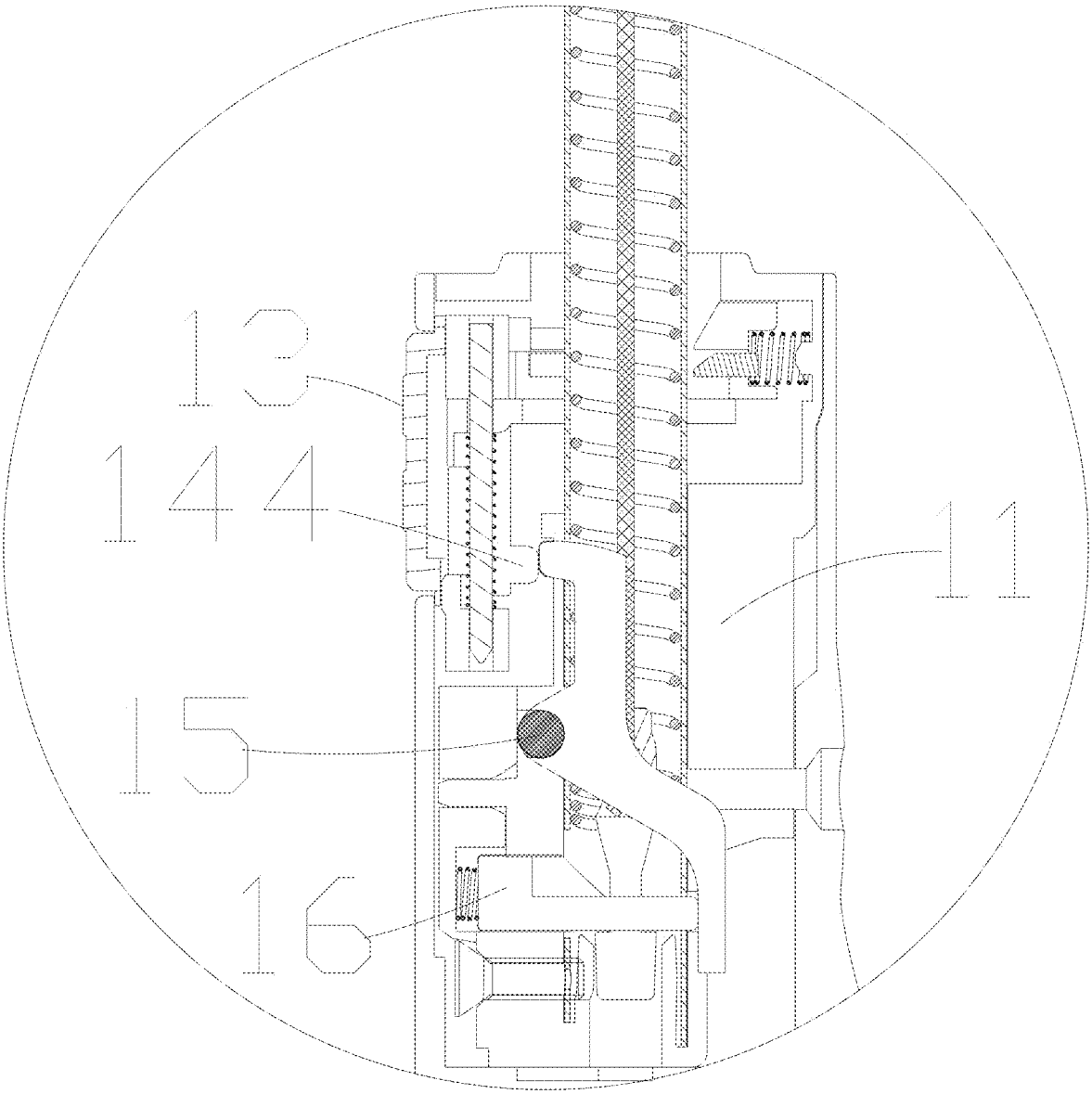

FIG. 4 is an internal structure diagram of a handle in some embodiments of the present disclosure when an umbrella fabric is folded.

Figure 5:
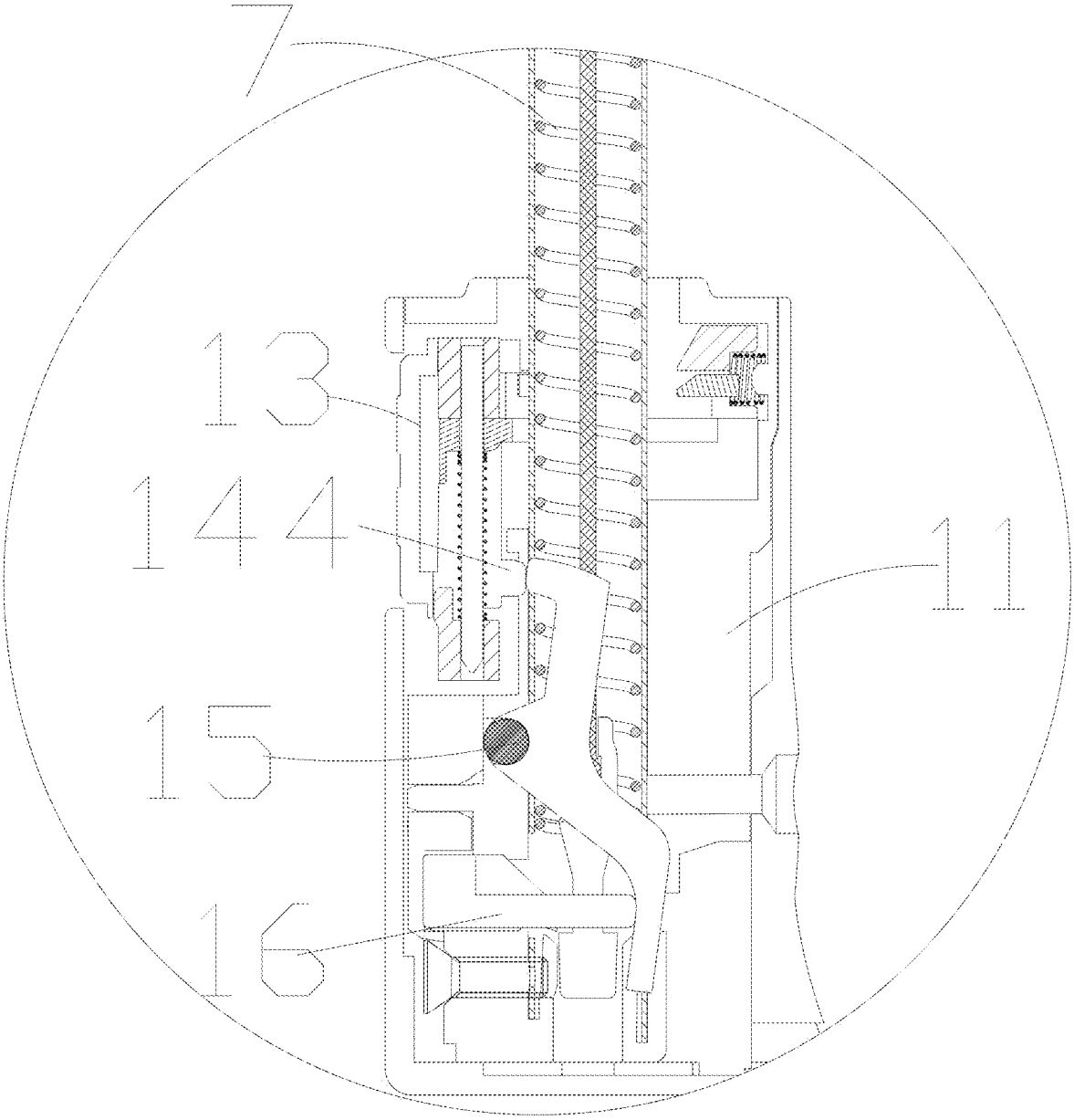

FIG. 5 is an internal structure diagram of a handle in some embodiments of the present disclosure when an umbrella is manually folded.

Figure 6:
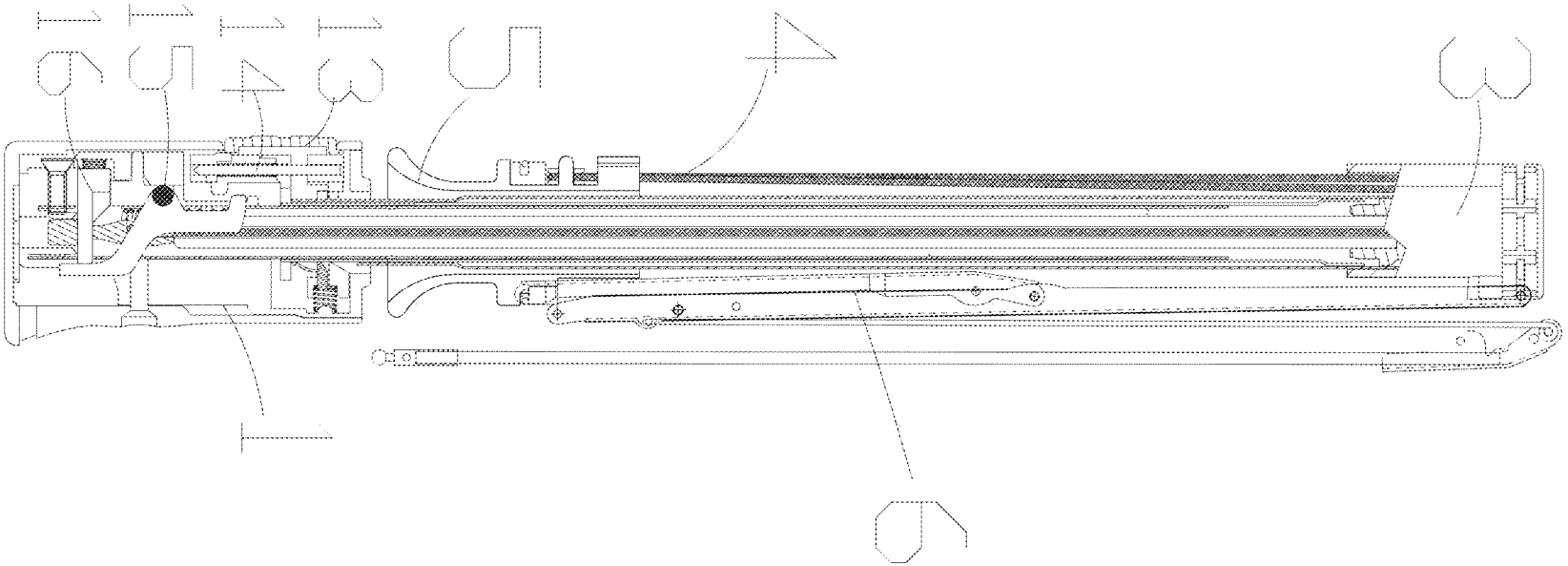

FIG. 6 is an overall structure diagram of a folded umbrella in some embodiments of the present disclosure.

Figure 7:
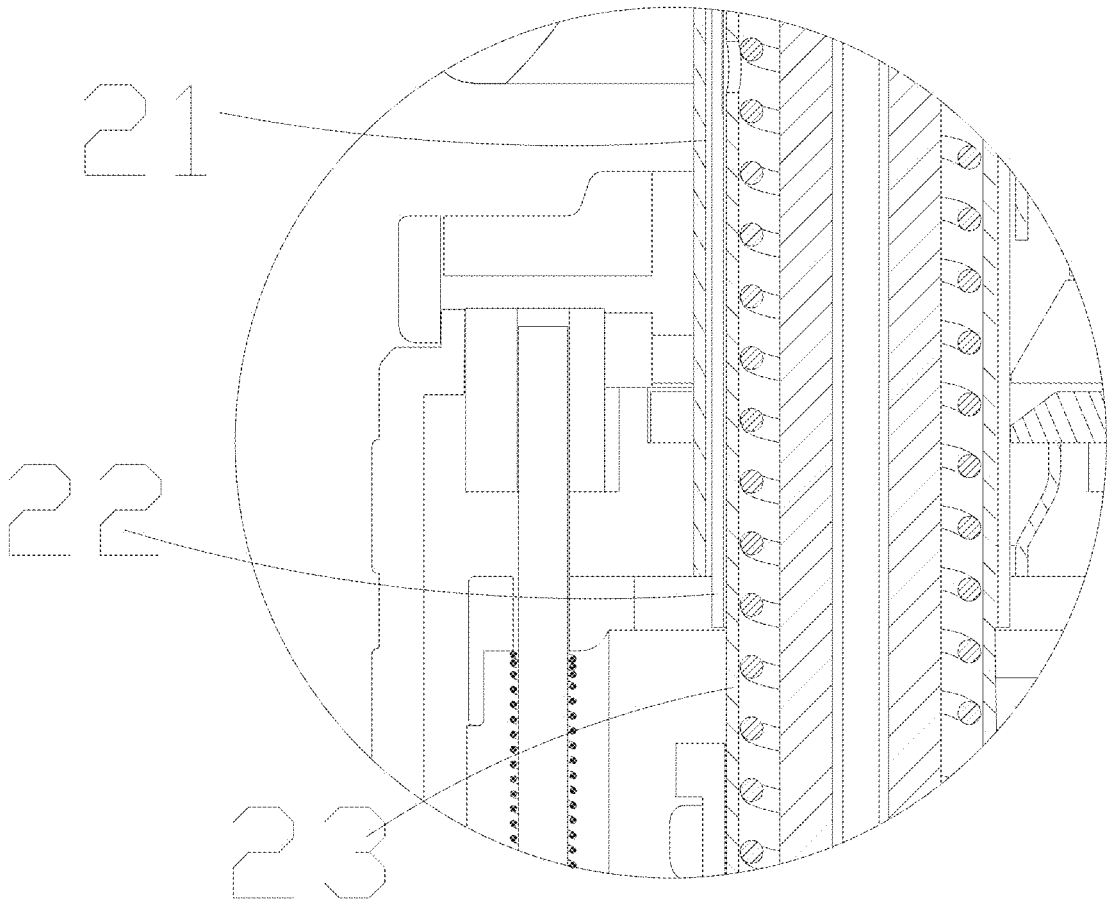

FIG. 7 is a structure diagram of a central rod in some embodiments of the present disclosure.

Figure 8:
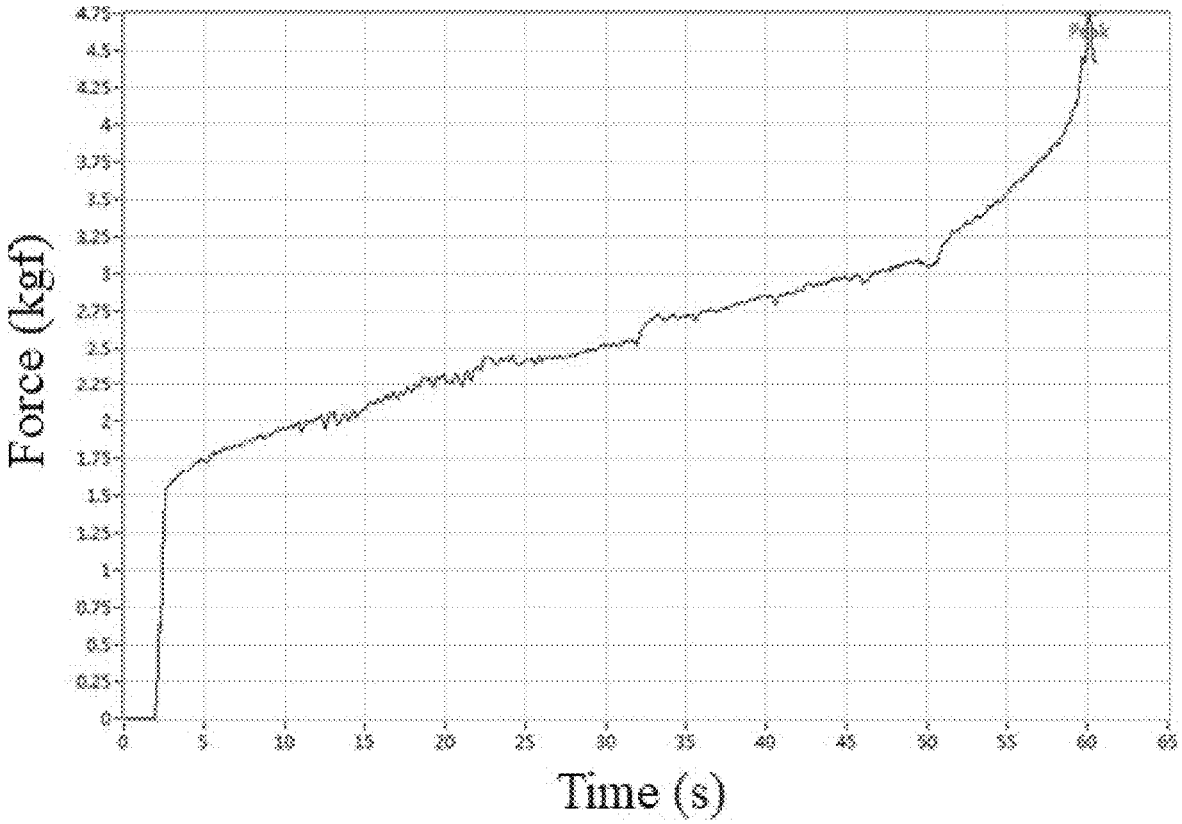

FIG. 8 is a test chart of a force for folding of umbrella in an Embodiment 2 of the present disclosure.

Figure 9:
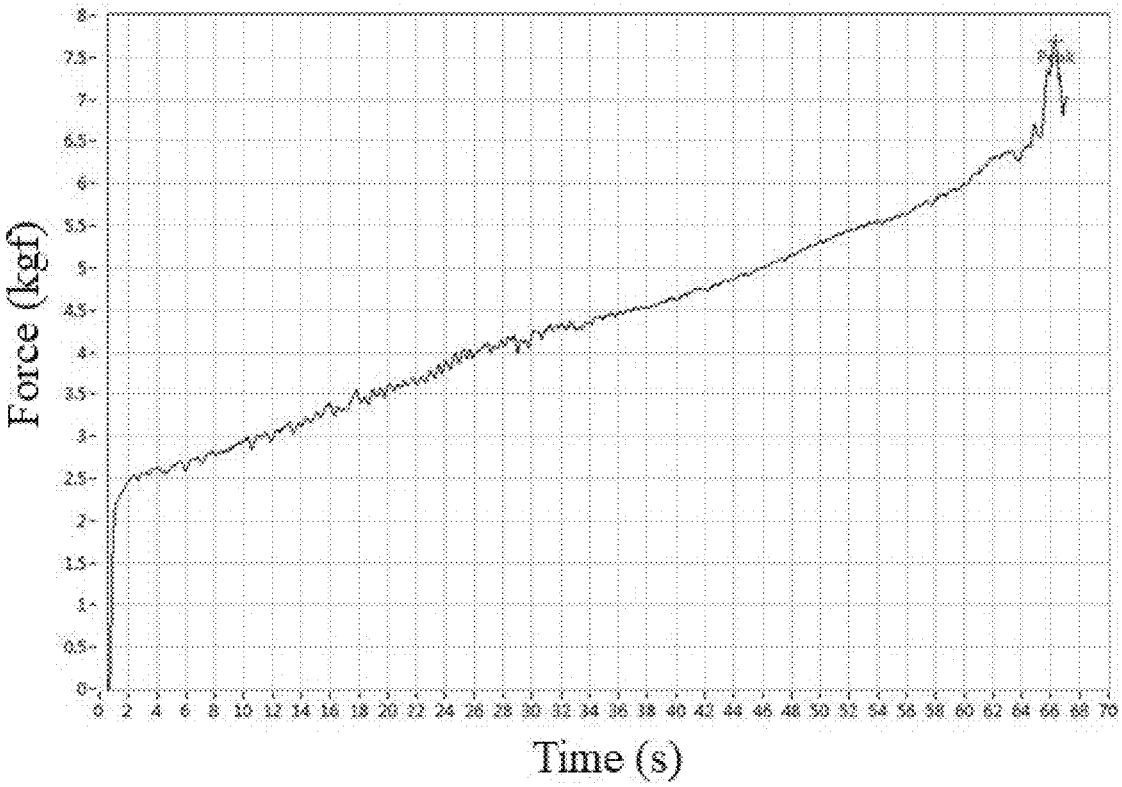

FIG. 9 is a test chart of a force for folding of umbrella in a Contrast Example 1 of the present disclosure.

Figure 10:
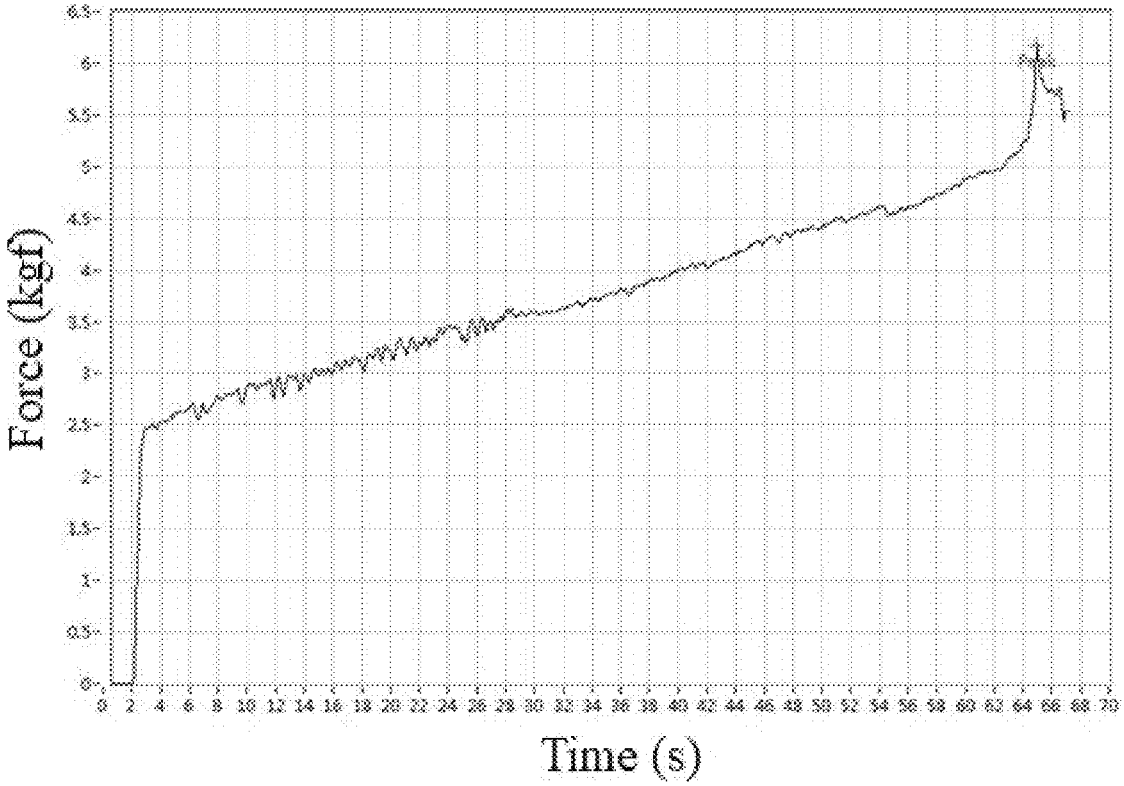

FIG. 10 is a test chart of a force for folding of umbrella in a Contrast Example 2 of the present disclosure.

Below is the description of designators on the accompanying drawings.

1, a handle;
11, a main body seat;
12, an accommodation cavity;
13, a moveable button;
131, a U-shaped iron; 132, a button spring; 133, an external button;
14, a slide assembly;
141, a slider spring; 142, a slide block; 143, a slider guide pin; 144, a slide block protrusion;
15, an H-shaped lever;
151, a rotating shaft; 152, a lever arm; 153, a power arm protrusion;
16, a baffle assembly;
161, a baffle; 162, a baffle spring;
2, a central rod;
21, an inner tube; 22, a middle tube; 23, an outer tube;
3, a notch;
4, a pulley assembly;
41, a pull rope; 42, a hook;
5, a runner;
6, an umbrella rib; and
7, a first spring.

DETAILED DESCRIPTION

To make the purpose, the technical solution and the advantages of the present disclosure better understood, the present disclosure is described below in further detail in conjunction with specific embodiments. It should be understood that the specific embodiments described below are merely to illustrate, but to limit, the present disclosure.

In addition, in the description of the present disclosure, it is to be understood that the orientation or position relations indicated by such terms as "central", "above", "below", "front", "rear", "left", "right", "vertical", "horizontal", "top", "bottom", "inside", "outside", "axial", "radial", "circumferential", etc. are based on the orientation or position relations shown in the drawings, and are merely for conveniently describing the present disclosure and simplifying the description, rather than indicating or implying that the device or element must have the specific orientation and be constructed and operated according to the specific orientation. Therefore, they should not be construed as a limitation on the present disclosure.

In the description of the present disclosure, unless otherwise specifically stated and defined, terms such as "mounted", "interconnected", "connected", "fixed", etc. should be interpreted expansively. For example, they may be fixed connection, also may be detachable connection, or integration; may be direct connection, also may be indirect connection through an intermediate, and may be internal communication between two elements or interaction of two elements. However, those marked as direct connection indicate that two connected bodies do not form a connection relationship through a transitional structure, but only form an entire body through a connection structure. The ordinary skill in this field can understand the specific implication of the above terms in the present disclosure in accordance with specific conditions.

In the present disclosure, unless otherwise specified and limited, the phrase that the first feature is above or below the second feature may be that the first feature and the second feature are in direct contact, or the first feature and the second feature are indirect contact through an intermediate medium. In the description of the present specification, terms such as "one embodiment", "some embodiment", "example", "specific example", or "some examples" mean that the specific features, structures, materials, or features described in combination with the embodiment or example are included in at least one embodiment or example of the present disclosure. In the specification, indicative expressions of the above terms do not necessarily refer to the same embodiments or examples. Moreover, the specific features, structures, materials or features described may be combined in an appropriate manner in any one or more embodiments or examples.

Embodiment 1

The present embodiment provides a folding and unfolding labor-saving automatic structure, including a main body seat 11, a moveable button 13, a baffle assembly 16 and an H-shaped lever 15. The main body seat 11 has an accommodation cavity 12 formed therein. The moveable button 13 is moveably arranged inside the main body seat 11 and has a slide assembly 14 arranged thereon. The baffle assembly 16 is arranged inside the accommodation cavity 12 and is located below the moveable button 13. The H-shaped lever 15 is rotatably arranged inside the accommodation cavity.

Herein, the H-shaped lever 15 includes a rotating shaft 151 arranged inside the accommodation cavity 12 and two lever arms 152 rotatably connected to the rotating shaft 151, wherein the lever arm 152 portions above the rotating shaft 151 are power arms, the lever arm 152 portions below the rotating shaft 151 are resistance arms, the power arms are provided thereon with power arm protrusions 153, the two power arm protrusions 153 can moveably abut against the slide assembly 14, and the two resistance arms abut against the baffle assembly 16.

The slide assembly 14 includes a slider spring 141, a second chute and a slide block 142. The moveable button 13 is formed with a first chute. The slide block 142 is formed therein with a second chute communicated with the first chute. The slider spring 141 has one end connected to the slide block 142 and the other end running through the second chute and the first chute to connect to the moveable button 13. The slide block 142 is provided thereon with two slide block protrusions 144 that moveably abut against the power arm protrusions 153. The main body seat 11 is equivalent to the handle 1 in an umbrella. The arranged accommodation cavity 12 is configured to fix the central rod 2. The horizontally moveable button 13 is configured to control the folding and unfolding of the umbrella. When the umbrella is folded, the runner 5 abuts against the slide assembly 14, whereby the slide block 142 can be depressed under the function of the slider spring 141. Since the tail end of the slide block 142 is provided with slide block protrusions 144, where the slide block protrusions 144 abut against the two power arm protrusions 153 on the power arms of the H-shaped lever 15 in an original state, so that the H-shaped lever 15 is slightly rotated, during the depressing process, the protrusions of the two disengage from one another, the slide block protrusions 144 move downwardly while the H-shaped lever 15 is restored.

The baffle assembly 16 includes a baffle 161, a baffle spring 162 and a U-shaped baffle 161 sleeve. The baffle 161 is moveably arranged inside a bottom of the baffle 161 sleeve and is connected to the main body seat 11 through the baffle spring 162. A top of the baffle 161 sleeve is a baffle arm. Two baffle arms abut against the resistance arms. The baffle 161 can horizontally move under the function of the baffle spring 162. A hook 42 of the automatic umbrella is buckled between the two baffle arms. Tail ends of the baffle arms abut against tail ends of the resistance arms. When the resistance arms move, the baffle arms are pushed, the baffle spring 162 is compressed, and the hook 42 fixed between the two baffle arms is released. When the hook 42 is again clamped between the two baffle arms, due to the arrangement of the baffle spring 162, the clamping process is smooth, causing no movement of the resistance arms.

The main body seat 11 is formed therein with a button slot perpendicular to an extension direction of the accommodation cavity 12. The moveable button 13 is arranged inside the button slot. The moveable button 13 includes a U-shaped iron 131 and a button spring 132. The U-shaped iron 131 is moveably connected to the main body seat 11 through the button spring 132. The arrangement of the button spring 132 allows the U-shaped iron 131 to move horizontally, thereby completing the buckling process of the runner 5 during the manual folding of umbrella. Meanwhile, the horizontal movement of the moveable button 13 can change the abutting state between the slide block protrusion 144 and the power arm protrusion 153, achieving the collapsing of the umbrella fabric. The moveable button 13 further includes an external button 133. The external button 133 is connected to the U-shaped iron 131 and is extended to outside the accommodation cavity 12. The first chute is arranged above the external button 133. A slider guide pin 143 is further arranged inside the slider spring 141. The external button 133 is extended to outside the accommodation cavity 12 for a user to touch. The external button 133 is further connected to the slide assembly 14 and the U-shaped iron 131 through the slider guide pin 143. When the external button 133 is pressed to unfold the umbrella automatically, the U-shaped iron 131 moves, the runner 5 disengages from the buckling state to move upwardly, the pressure against the slide assembly 14 disappears, and the slide block protrusion 144 moves upwardly under the function of the slider spring 141 to abut against the power arm protrusion 153 again, and the H-shaped lever 15 is slightly rotated.

According to the present embodiment, the position of the baffle assembly 16 is arranged close to the tail portion of the handle 1, greatly prolonging the contraction space of the first spring 7, whereby reducing the degree of compression, and when compressing downward the same length of spring, a user needs to apply a less force, achieving the purpose of labor-saving folding of umbrella. In addition, since the position of the baffle assembly 16 is moved downward, a distance between the slide assembly 14 located above the baffle assembly 16 and the baffle assembly 16 increases. Hence, the present disclosure arranges an H-shaped lever 15 between the slide assembly 14 and the baffle assembly, so that the H-shaped lever 15 can achieve a moveable connection between the slide assembly 14 and the baffle assembly 16. When the slide assembly 14 moves downwardly, the H-shaped lever 15 is triggered to rotate, driving the baffle assembly 16 to move, whereby completing the process of automatic folding and unfolding of umbrella.

Embodiment 2

The present embodiment further provides a folding and unfolding labor-saving automatic umbrella, including a central rod 2 and a handle 1 having the folding and unfolding labor-saving automatic structure, wherein the central rod 2 is provided therein with a first spring 7 and a bullet like tip. The bullet like tip has a top end arranged inside the first spring 7 and a bottom end able to buckle with the baffle 161 so that the central rod 2 is folded.

Herein, the folding and unfolding labor-saving automatic structure includes a main body seat 11, a moveable button 13, a baffle assembly 16 and an H-shaped lever 15. The main body seat 11 has an accommodation cavity 12 formed therein. The moveable button 13 is moveably arranged inside the main body seat 11 and has a slide assembly 14 arranged thereon. The baffle assembly 16 is arranged inside the accommodation cavity 12 and is located below the moveable button 13. The H-shaped lever 15 is rotatably arranged inside the accommodation cavity.

The H-shaped lever 15 includes a rotating shaft 151 arranged inside the accommodation cavity 12 and two lever arms 152 rotatably connected to the rotating shaft 151, wherein the lever arm 152 portions above the rotating shaft 151 are power arms, the lever arm 152 portions below the rotating shaft 151 are resistance arms, the power arms are provided thereon with power arm protrusions 153, the two power arm protrusions 153 can moveably abut against the slide assembly 14, and the two resistance arms abut against the baffle assembly 16.

The slide assembly 14 includes a slider spring 141, a second chute and a slide block 142. The moveable button 13 is formed with a first chute. The slide block 142 is formed therein with a second chute communicated with the first chute. The slider spring 141 has one end connected to the slide block 142 and the other end running through the second chute and the first chute to connect to the moveable button 13. The slide block 142 is provided thereon with two slide block protrusions 144 that moveably abut against the power arm protrusions 153.

The baffle assembly 16 includes a baffle 161, a baffle spring 162 and a U-shaped baffle 161 sleeve. The baffle 161 is moveably arranged inside a bottom of the baffle 161 sleeve and is connected to the main body seat 11 through the baffle spring 162. A top of the baffle 161 sleeve is a baffle arm. Two baffle arms abut against the resistance arms.

The main body seat 11 is formed therein with a button slot perpendicular to an extension direction of the accommodation cavity 12. The moveable button 13 is arranged inside the button slot. The moveable button 13 includes a U-shaped iron 131 and a button spring 132. The U-shaped iron 131 is moveably connected to the main body seat 11 through the button spring 132. The moveable button 13 further includes an external button 133. The external button 133 is connected to the U-shaped iron 131 and is extended to outside the accommodation cavity 12. The first chute is arranged above the external button 133. A slider guide pin 143 is further arranged inside the slider spring 141.

Furthermore, the central rod 2 includes an inner tube 21, a middle tube 22 and an outer tube 23. The middle tube 22 is sleeved outside the inner tube 21. The outer tube 23 is sleeved outside the middle tube 22. The outer tube 23 is provided thereon with a notch 3. A runner 5 is sleeved outside the outer tube 23. The outer tube 23 is provided with a wedge-shape block. The moveable button 13 is buckled with the wedge-shape block. The outer tube 23 abuts against the slide assembly 14. The central rod 2 is equivalent to a central rod 2 in a conventional manual folding umbrella, which is arranged as several segments to complete conventional folding functions. Herein, the inner tube 21 arranged inside the middle tube 22 is longer than that of a conventional automatic umbrella, which is configured to contain and protect the first spring 7 and maintain the stable movement of the first spring. The inner tube 21 is extended to the baffle assembly 16 inside the handle 1, for the hook 42 inside the first spring 7 to buckle with the baffle assembly 6. The outer tube 23 is connected to the runner 5 and is arranged below the runner 5. When the umbrella is folded, the runner 5 is pulled downwardly and the outer tube 23 abuts against the slide assembly 14 first, so that the slide assembly 14 slides downwardly. Meanwhile, the wedge-shape block arranged on the outer tube 23 is buckled with the U-shaped iron 131 on the slide assembly 14, fixing the outer tube 23 and the runner 5. The first spring 7 is arranged inside the inner tube 21.

The notch 3 is provided therein with a pulley assembly 4. The pulley assembly 4 includes a pull rope 41. The pull rope 41 has one end connected to the notch 3 and the other end extending through the first spring 7. The other end of the pull rope 41 is provided with a hook 42. The hook 42 is clamped on the baffle assembly 16. The pulley assembly 4 is a conventional arrangement in existing automatic umbrellas. The pulley assembly 4 includes a first pulley and a second pulley. The first pulley is arranged inside the notch 3 and the second pulley is arranged inside the runner 5. The pull rope 41 is arranged between the first pulley and the second pulley. One end of the pull rope 41 is fixed on the notch 3, while the other end passes around the second pulley located inside the runner 5 and then goes toward the first pulley located inside the notch 3. After passing around the first pulley, the pull rope 41 penetrates through the first spring 7 and has the other end buckled on the baffle assembly 16 inside the handle 1 through the hook 42 at the tail end. The baffle assembly 16 can release the hook 42, and the up-down movement of the hook 42 can achieve the up-down movement of the runner 5 synchronously. When the baffle assembly 16 is buckled with the hook 42, the runner 5 is located at the top of the umbrella. When the baffle assembly 16 releases the hook 42, the runner 5 descends some distance, meanwhile causing the umbrella fabric to collapse.

The umbrella rib 6 includes an upper pull rod and a lower pull rod between which is arranged a second spring. Conventional automatic umbrellas have a second spring for folding umbrella added between the upper and lower pull rods of the umbrella rib 6. The number of the second springs is the same as that of the umbrella ribs. When to fold the umbrella, a user presses the button, then the runner 5 descends some distance along the central rod 2. Under the driving of the second spring, the upper pull rod is collapsed, and the entire umbrella fabric is folded. Then the user pulls the descended runner 5 to the handle 1 to buckle, whereby completing the entire folding process of umbrella.

Contrast Example 1

The present contrast example is an anti-rebound automatic folding and unfolding umbrella, where during the folding process a central rod can be stopped at any time while being retracted.

Contrast Example 2

The present contrast example is an automatic umbrella with two springs, where the two springs can be overlapped on a spring connection sleeve while folding and unfolding the umbrella.

Test of Force for Folding of Umbrella

A desktop electric universal material testing machine (model TH-8201A) is employed to test the force for folding of umbrella of the Embodiment 2, the Contrast Example 1 and the Contrast Example 2. The test data is as shown in the following table and FIG. 8 to FIG. 10.

| No. | Maximum force (kgf) | Displacement of maximum force point (mm) | Stretch strength (MPa) | Maximum force elongation (%) |
|---|---|---|---|---|
| Embodiment 2 | 4.740 | 271.979 | 4.648 | 271.979 |
| Contrast Example 1 | 7.685 | 308.072 | 7.536 | 308.072 |
| Contrast Example 2 | 6.170 | 294.772 | 6.051 | 294.772 |

From the above table, the force for folding of umbrella in the Embodiment 2 needs utmost 4.740 kgf, while the force for folding of umbrella in the Contrast Example 1 needs utmost 7.685 kgf and needs utmost 6.170 kgf in the Contrast Example 2. Therefore, the maximum force for folding of umbrella of the Embodiment 2 is far less than the Contrast examples 1 and 2, indicating that the force for folding of umbrella of the Embodiment 2 is greatly reduced, with a great labor-saving effect.

It should be understood that the embodiments provided in the present disclosure are not limited to the specific processing steps or materials disclosed herein, but should be extended to equivalent substitutions of such features understood by the ordinary skill in the related art. Further, it should be understood that the terms used herein are merely for the purpose of description of specific embodiments, rather than to limit the present disclosure.

The "embodiment" mentioned in the description means that the specific features, or characteristics described in combination with the embodiment are included in at least one embodiment of the present disclosure. In the description, phrases or "embodiments" appearing throughout the entire description do not necessarily refer to one same embodiment.

Moreover, the features or characteristics described may be combined in an appropriate manner into one or more embodiments. In the above description, some specific details, such as thickness, number, etc., are provided to comprehensively understand the present disclosure. However, those skilled in the related art should understand that the present disclosure can be implemented without the above one or more specific details or can be implemented by other methods, assemblies, materials, etc.

What is claimed is:

1. A folding and unfolding labor-saving automatic structure, comprising:

a main body seat having an accommodation cavity formed therein;

a moveable button moveably arranged inside the main body seat and having a slide assembly arranged thereon;

a baffle assembly arranged inside the accommodation cavity and located below the moveable button;

an H-shaped lever rotatably arranged inside the accommodation cavity, comprising a rotating shaft arranged inside the accommodation cavity and two lever arms rotatably connected to the rotating shaft, wherein one lever arm of the two lever arms above the rotating shaft is a power arm, the other one lever arm of the two lever arms below the rotating shaft is a resistance arm, the power arm is provided thereon with power arm protrusions, the power arm protrusions moveably abut against the slide assembly, and the resistance arm abuts against the baffle assembly.

2. The folding and unfolding labor-saving automatic structure according to claim 1, wherein the slide assembly comprises a slider spring, a second chute and a slide block;

the moveable button is formed with a first chute;

the slide block is formed therein with the second chute communicated with the first chute;

the slider spring has one end connected to the slide block and the other end running through the second chute and the first chute to connect to the moveable button; and the slide block is provided thereon with two slide block protrusions that moveably abut against the power arm protrusions.

3. The folding and unfolding labor-saving automatic structure according to claim 2, wherein the main body seat is formed therein with a button slot perpendicular to an extension direction of the accommodation cavity;

the moveable button is arranged inside the button slot; the moveable button comprises a U-shaped iron and a button spring; and the U-shaped iron is moveably connected to the main body seat through the button spring.

4. The folding and unfolding labor-saving automatic structure according to claim 3, wherein the moveable button further comprises an external button; the external button is connected to the U-shaped iron and is extended to outside the accommodation cavity; the first chute is arranged above the external button; and a slider guide pin is further arranged inside the slider spring.

5. The folding and unfolding labor-saving automatic structure according to claim 1, wherein the baffle assembly comprises a baffle, a baffle spring and a U-shaped baffle sleeve;

the baffle is moveably arranged inside a bottom of the baffle sleeve and is connected to the main body seat through the baffle spring; a top of the baffle sleeve is a baffle arm; and the baffle arm abuts against the resistance arm.

6. A folding and unfolding labor-saving automatic umbrella, comprising a central rod and a handle having the folding and unfolding labor-saving automatic structure according to claim 1, wherein the central rod is provided therein with a first spring and a bullet like tip, the bullet like tip has a top end arranged inside the first spring and a bottom end able to buckle with the baffle so that the central rod is retracted.

7. The folding and unfolding labor-saving automatic umbrella according to claim 6, wherein the central rod comprises an inner tube, a middle tube and an outer tube; the middle tube is sleeved outside the inner tube; the outer tube is sleeved outside the middle tube; the outer tube is provided thereon with a notch; a runner is sleeved outside the outer tube; the outer tube is provided with a wedge-shape block; the moveable button is buckled with the wedge-shape block; and the outer tube abuts against the slide assembly.

8. The folding and unfolding labor-saving automatic umbrella according to claim 7, wherein the first spring is arranged inside the inner tube.

9. The folding and unfolding labor-saving automatic umbrella according to claim 7, wherein the notch is provided therein with a pulley assembly; the pulley assembly comprises a pull rope; the pull rope has one end connected to the notch and the other end extending through the first spring; the other end of the pull rope is provided with a hook; and the hook is clamped on the baffle assembly.

10. The folding and unfolding labor-saving automatic umbrella according to claim 6, further comprising an umbrella rib, wherein the umbrella rib comprises an upper pull rod and a lower pull rod between which is arranged a second spring.

* * * * *